US008052493B2

(12) United States Patent
Webb

(10) Patent No.: US 8,052,493 B2
(45) Date of Patent: Nov. 8, 2011

(54) ROWING OAR HANDLE

(76) Inventor: Emily Webb, South Wales (GB)

( * ) Notice: Subject to any disclaimer, the term of this patent is extended or adjusted under 35 U.S.C. 154(b) by 0 days.

(21) Appl. No.: 12/070,430

(22) Filed: Feb. 19, 2008

(65) Prior Publication Data

US 2008/0146099 A1 Jun. 19, 2008

Related U.S. Application Data

(62) Division of application No. 11/429,578, filed on May 5, 2006, now abandoned.

(30) Foreign Application Priority Data

May 5, 2005 (GB) ..... 0509193.9

(51) Int. Cl.
*B63H 16/04* (2006.01)
*B63H 16/10* (2006.01)

(52) U.S. Cl. ..... 440/102

(58) Field of Classification Search ..... 440/102, 440/101, 104, 105, 107, 108, 109, 110; 416/74
See application file for complete search history.

(56) References Cited

U.S. PATENT DOCUMENTS

| | | | | |
|---|---|---|---|---|
| 888,520 | A | 5/1908 | Merriman et al. | |
| 1,295,608 | A | 2/1919 | Schoen | |
| 3,970,032 | A | 7/1976 | Phillips | |
| 4,074,542 | A | 2/1978 | Hankosky et al. | |
| 5,387,143 | A * | 2/1995 | Pitman | 440/101 |
| 5,902,162 | A | 5/1999 | Kot et al. | |

FOREIGN PATENT DOCUMENTS

SU 152081 11/1989

* cited by examiner

*Primary Examiner* — Daniel Venne
(74) *Attorney, Agent, or Firm* — Levy & Grandinetti

(57) ABSTRACT

A rowing oar handle comprising a first portion and a second portion, in which the first portion and the second portion are axially rotatable to one another, and in which in use the point of rotation is located between a user's hands.

2 Claims, 2 Drawing Sheets

A
B
46
43
50
49
42
44
40
45
47
48
51
41
A
B

ROWING OAR HANDLE

CROSS-REFERENCE TO RELATED APPLICATIONS

This application is a divisional of U.S. application Ser. No. 11/429,578, filed on May 5, 2006, which claims priority from United Kingdom Application No. 0509193.9, filed May 5, 2005, the disclosure of which is incorporated herein by reference.

BACKGROUND OF THE INVENTION

This invention relates to a rowing oar handle, for use particularly but not exclusively in the sport of competitive rowing.

In rowing the oars are feathered between strokes. At the end of the stroke the user rotates the oar through about 90 degrees such that the blade is parallel with the water, and just prior to the beginning of the stroke the oar is rotated back so the blade can enter the water vertically.

Rowing oar handles are commonly made of wood, which is provided with a roughened surface to aid grip in the wet conditions. The action of rotating the oar to feather the blade is therefore very tough on the hands and often leads to blisters and other injuries.

SUMMARY OF THE INVENTION

The present invention is intended to overcome some of the above problems.

Therefore, according to the present invention a rowing oar handle comprises a first portion and a second portion, in which the first portion and the second portion are axially rotatable in relation to one another, and in which in use the point of rotation is located between a user's hands.

With this arrangement only the inner hand need rotate the handle to feather the blade while the outer hand can stay put. (In this specification the terms "inner", "outer", "inside" and "outside" are to be understood to relate to the handle, which has an outer end at which it terminates, and an inner end which in use is adjacent an oar body. Thus, inner and inside mean closer to the oar body, and outer and outside mean further away from the oar body.)

In a preferred construction the first portion can be located outside the second portion. The first portion can be provided with a flange at its inner end, and the second portion can be provided with a flange at its outer end.

With this arrangement the two flanges face one another and provide a clear physical and visual indicator of the point of rotation, about which the user places their hands.

In will be appreciated that there are many known ways to construct a suitable pivot for the invention. However, in a preferred construction a spigot member can be centrally axially mounted to the second member in a rotating manner. The first portion can be provided with an axially extending socket, and the outer end of the spigot member can be non-rotatably mounted in said socket.

The spigot member can comprise a cylindrical body provided with a flange at its inner end, and the spigot member can be mounted to the second member by block means which can be non-rotatably fixed to the second portion. The block means can be provided with a central aperture comprising a first section and a second section. The second section can have a greater diameter than the first section and can be inside the first section. The flange of the spigot member can be disposed in the second section of said aperture and the body of the spigot member can pass through the first section of said aperture.

In a preferred construction the first portion and the second portion can be dismantled from one another. To facilitate this the block means can be mounted to the second portion by means of a number of screws which can be located on a circle which is co-axial with the flange of the second portion. The flange of the first portion can be provided with an aperture which is also positioned on said circle, such that the aperture can be axially aligned with each screw thereby to allow the screws to be accessed to assemble or dismantle the first and second portions of the handle.

In one construction the block means may comprise two parts, a first part being provided with an aperture comprising the above described first section of the central aperture, and a second part being provided with an aperture comprising the above described second section of the central aperture. The two parts can be axially aligned and fixed together with said screws. This arrangement is more readily constructed because the first and second sections of the central aperture can be simply drilled through the first part and the second part, as opposed to the second section having to be created with some kind of mortiser tool as would be the case if the block means were one component.

It will be appreciated that a number of different surfaces bear against one another in the above described handle. Therefore, in a preferred construction a bearing surface can be provided on an outermost facing surface of the block means and/or on an inner facing surface of the flange of the first portion.

A bearing surface can also be provided on an inner facing surface of the flange of the spigot member and/or on the outermost facing surface of the second portion adjacent to the flange of the spigot member, as well as on the outermost facing surface of the flange of the spigot member and/or on the inner facing surface of the second section of the central aperture of the block means. Bearing surfaces can also be provided on inner radial surfaces of the central aperture and on outer radial surfaces of the spigot member which contact one another in use.

It will be appreciated that rowers come in different sizes, and thus the location or orientation of their hands on an oar handle can be different. Thus, in a preferred embodiment the rowing oar handle can be dimensioned such that in use it is of suitable size for the intended user.

In addition to the damage caused to a rower's hands when feathering an oar as described above, when a rower grips the cylindrical shape of known rowing oar handles for the stroke, the flesh of their hands is compressed in an unnatural way. This does not cause any problems for one or two strokes, but a rower may perform hundreds of strokes a session. The user grips the rough wooden surface with considerable force as all the power provided by their legs, torso and arms in pulling the stroke is transmitted through their grip on the handle. This unnatural, repetitive and high force grip is the primary cause of blisters and other skin injuries to rowers' hands.

Therefore, the applicant's co-pending UK Patent Application GB 0509194.7 discloses a rowing or sculling oar handle in which when the handle is orientated for a stroke it has an axial cross-sectional shape with a greater horizontal extent than vertical extent. The handle can be provided with a substantially oval axial cross sectional shape and an underside of the axial cross-sectional shape can be provided with an abutment. In a preferred embodiment described therein the axial cross-sectional shape can comprise a first portion proximal to the user, a central portion, and a second portion distal to the user, in which the first portion is substantially shaped as more than half an oval, in which the second portion is substantially shaped as less than half an oval, in which a centre of the oval of which the second portion forms a part is vertically lower than a centre of the oval of which the first portion forms a part, in which an upper surface of the central portion follows a smooth line of curvature from the first portion to the second portion, and in which a lower surface of the central portion follows a substantially straight line from the first portion to the second portion.

Therefore, in a preferred embodiment of this invention, when the first and the second portion of the handle are axially aligned when orientated for a stroke, the first portion and the second portion can be provided with an axial cross-sectional shape with a greater horizontal extent than vertical extent.

Preferably the handle can be provided with a substantially oval axial cross sectional shape and an underside of the axial cross-sectional shape can be provided with an abutment.

The axial cross-sectional shape can comprise a first portion proximal to the user in an in use position, a central portion, and a second portion distal to the user in an in use position. The first portion can be substantially shaped as more than half an oval, the second portion can be substantially shaped as less than half an oval, and a centre of the oval of which the second portion forms a part can be vertically lower than a centre of the oval of which the first portion forms a part. An upper surface of the central portion can follow a smooth line of curvature from the first portion to the second portion, and a lower surface of the central portion can follow a substantially straight line from the first portion to the second portion.

Therefore the abutment described above can be provided by the lower surface of the central portion. The purpose of the abutment is to provide a surface against which a user's thumb can contact in use. Clearly, different users will have different sized hands, and therefore the handle can be dimensioned for a particular age group, or user's hands. Thus, in a preferred embodiment the handle can be dimensioned such that when a user's hand grips the handle in the conventional way, their thumb can contact the abutment.

The purpose of the particular axial cross-sectional shape described above is to alleviate the damaging compression of the flesh of the hands caused when a traditional cylindrical handle is used. The cross-sectional shape is generally oval shaped, but the two ends of the oval, the first and second portions, are vertically miss-aligned. This provides a shape which when gripped hard and pulled causes far less compression of the flesh of the hands than a simple circular shape.

The handle can taper towards its outer end in the known manner, and the handle can be produced from wood. It can also be produced from any other suitable known material.

The handle can be formed as an integral part of an oar, or it can be a removable handle which can be attached and removed from an oar in the known way.

The invention can be performed in various ways, but one embodiment will now be described by way of example, and with reference to the accompanying drawings in which:

DETAILED DESCRIPTION

Figure 1:
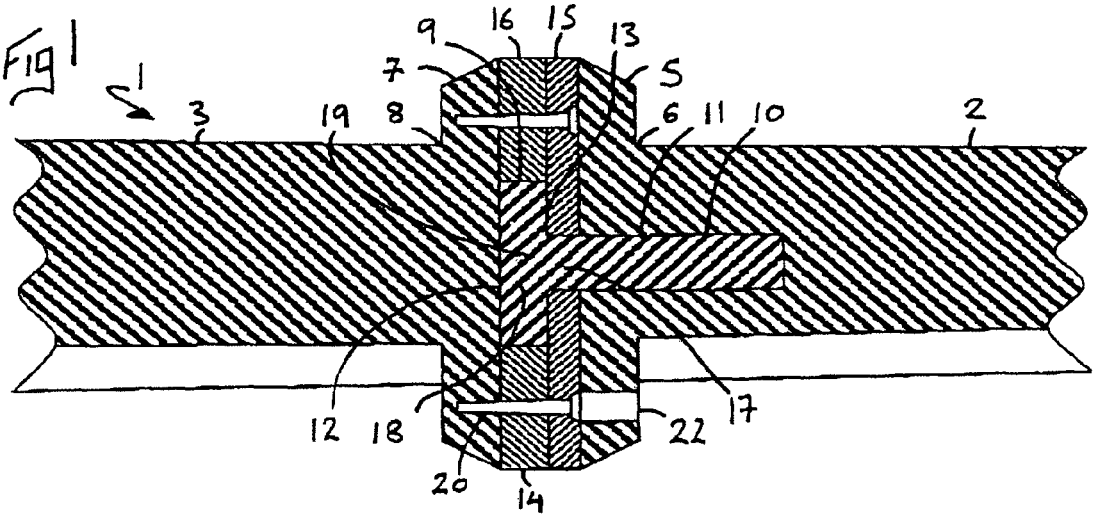
FIG. 1 is a cross-sectional side view of a rowing oar handle according to the present invention.

As shown in FIG. 1 a rowing oar handle 1 comprises a first portion 2 and a second portion 3, in which the first portion 2 and the second portion 3 are axially rotatable in relation to one another, and in which the point of rotation 4 is located between the regular positions of a user's hands (not shown).

The first portion 2 is provided with a flange 5 at its inner end 6, and the second portion 3 is provided with a flange 7 at its outer end 8. With this arrangement the two flanges 5 and 7 face one another and, as is clear from FIG. 1, provide a clear physical and visual indicator of the point of rotation 4, about which the user places their hands (not shown).

The first portion 2 and the second portion 3 are axially rotatable in relation to one another by means of spigot member 9, which is centrally axially mounted to the second member 3 in a rotating manner.

The first portion 2 is provided with an axially extending socket 10, and the outer end 11 of the spigot member 9 is non-rotatably mounted in said socket 10.

The spigot member 9 is a cylindrical body provided with a flange 12 at its inner end 13, and it is mounted to the second member 3 by block means 14, which comprises first part 15 and second part 16 which are both mounted to the second portion 3 in a non-rotating manner. The two parts 15 and 16 each have an aperture 17 and 18 respectively, which combine to form a central aperture 19 through the block means 14. The central aperture 19 has a first section formed by aperture 17 and a second section formed by aperture 18, which has a greater diameter.

The flange 12 of the spigot member 9 is disposed in the second section (18) of the central aperture 19 and the body of the spigot member 9 passes through the first section (17) of the central aperture 19. Thus the spigot member 9 is secured to the second portion 3 in a rotating manner.

Figure 3:
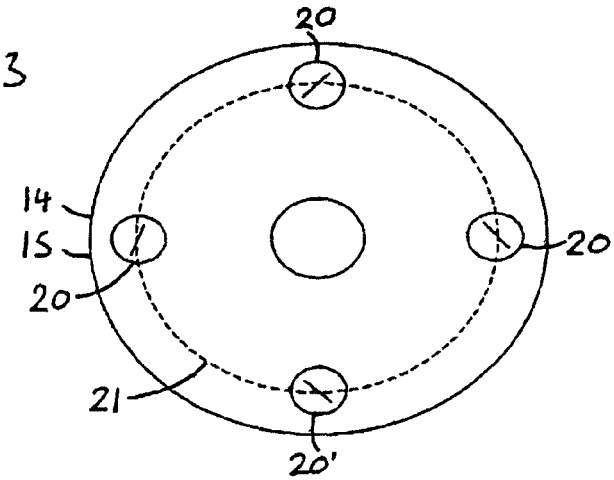
FIG. 3 is an end view of the rowing oar handle as shown in FIG. 1, with the first part (2) of the handle not shown; and, FIG. 4 is a diagrammatic axial cross-sectional view of the rowing oar handle.

Referring now to FIG. 3, the block means 14 is mounted to the second portion 3 by means of four screws 20, which are located on a circle, indicated at 21, which is co-axial with the flange 7 of the second portion 3.

Figure 2:
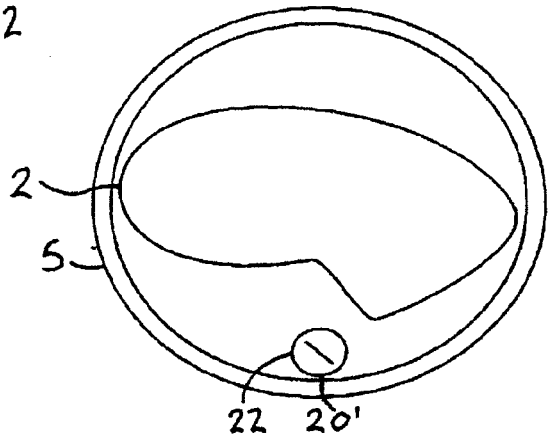
FIG. 2 is an end view of the rowing oar handle as shown in FIG. 1.

Referring now to FIG. 2, the flange 5 of the first portion 2 is provided with an aperture 22 which is also positioned on said circle 21.

The handle 1 tapers towards its outer end in the known manner, and it is made from wood.

Figure 4:
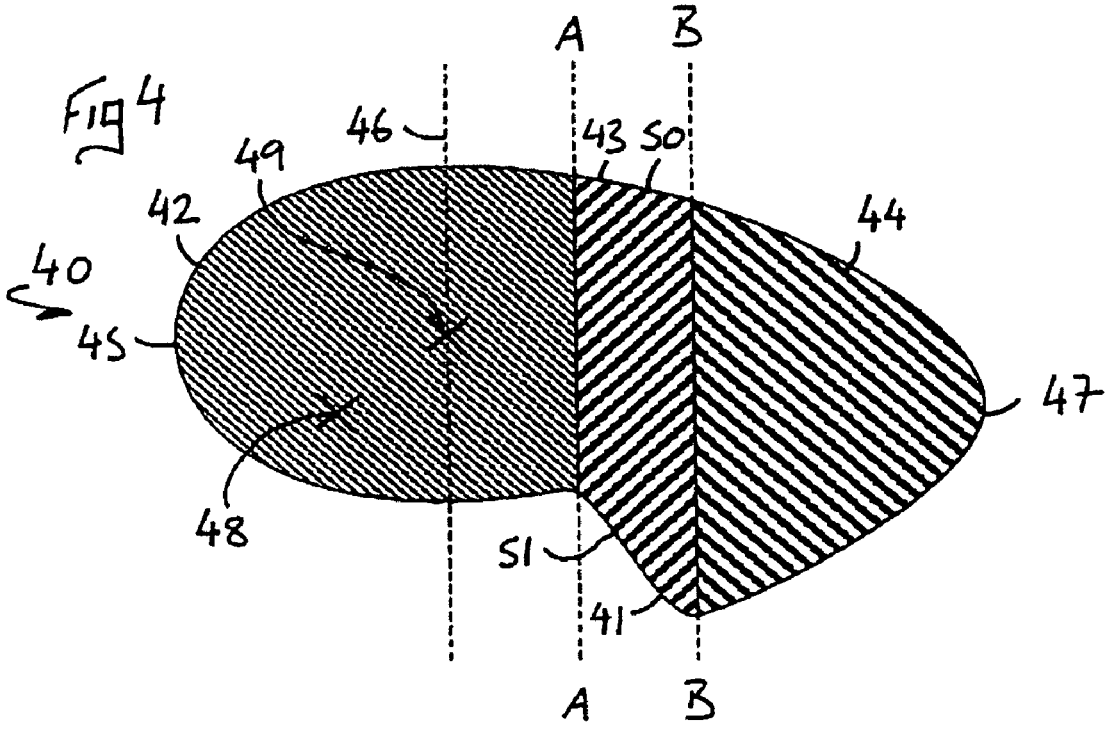

FIG. 4 shows a diagrammatic axial cross-sectional view of any part of the first part 2 or the second part 3 of the handle 1, when either part is orientated for a stroke, which is to say that the blade of an oar (not shown) of which the handle 1 is a part is substantially vertical and orientated for a stroke to be pulled. As is clear from FIG. 4 the axial cross-sectional shape 40 of the handle 1 has a greater horizontal extent than vertical extent, and an underside of said axial cross-sectional shape 40 is provided with an abutment 41.

The axial cross-sectional shape 40 comprises a first portion 42 proximal to the user (not shown), a central portion 43, and a second portion 44 distal to the user. (In FIG. 4 the three sections 42, 43, and 44 are shown in different cross-hatching, and are demarked by lines A and B to differentiate them.)

The first portion 42 is substantially shaped as more than half an oval. In other words it expands from an end point 45 to a middle axis 46 where it has its greatest height, then begins to taper towards an opposite end point.

The second portion 44 is substantially shaped as less than half an oval. In other words it expands from an end point 47 and does not reach a middle axis.

The oval of which the second portion 44 forms a part is a larger and flatter oval than the oval of which the first portion 42 forms a part, and as a result the second portion 44 is more pointed than the first portion 42, which is generally more round.

A centre 48 of the oval of which the second portion 44 forms a part is vertically lower than a centre 49 of the oval of which the first portion 42 forms a part.

An upper surface 50 of the central portion 43 follows a smooth line of curvature from the first portion 42 to the second portion 44. A lower surface 51 of the central portion 43 follows a substantially straight line from the first portion 42 to the second portion 43.

In use a rower grips the handle 1 with their hands either side of the pivot point 4. A rower should grip the handle with their hands substantially shoulder width apart, and the pivot point 4 is arranged accordingly.

The user's hands are arranged or oriented with their thumbs on the underside of the handle 1, and potentially in contact with the abutment 41, and their fingers over the top upper surface of the handle 1 and wrapped around it.

When the rower pulls a stroke the first portion 2 and the second portion 3 are axially aligned, as shown in FIG. 1.

However, between strokes when the blade of the oar (not shown) needs to be feathered, the rower rotates the second portion 3, and thus the rest of the oar and the blade, through substantially 90 degrees. Thus, to feather the blade, it is only necessary to rotate one hand, and not both. This alleviates the strain and wear on the rower's outside hand during repetitive strokes.

In addition, the axial cross-sectional shape shown in FIG. 4 reduces the harmful effects of rowing on both hands due to its more sympathetic shape which does not compress the flesh of the hands as much as the traditional cylindrical handle.

The handle 1 can be dismantled for repairs or simply for transport or storage. In order to dismantle the handle the first portion 2 is orientated to an axial rotational position in which the aperture 22 is aligned with one of the screws 22. In FIG. 2, the aperture 22 is aligned with screw 20'. The screw is then unscrewed and removed via the aperture 22. The first portion 2 is then rotated through 90 degrees until the aperture 22 is aligned with another of the screws 20, which can then be unscrewed. This is repeated four times until the components can be dismantled. (It will be appreciated that in the embodiment shown in the Figures the first part 15 of the block means 14, and the spigot member 9 remain fastened to the first portion 2 when it is removed from the second portion 3.)

In order to rebuild the handle 1 the above described process is performed in reverse.

The embodiment described above can be altered without departing from the scope of the invention. For example, in one alternative embodiment (not shown) the surfaces of the handle which rotate over other surfaces in use are provided with specially adapted bearing surfaces in the form of a layering of some suitable known material. Such bearing surfaces are provided on an outermost facing surface of the block means and on an inner facing surface of the flange of the first portion, and on an inner facing surface of the flange of the spigot member and on the outermost facing surface of the second portion adjacent to the flange of the spigot member, as well as on the outermost facing surface of the flange of the spigot member and on the inner facing surface of the second section of the central aperture of the block means (which in the embodiment described above would be the inner facing surface of the first part 15 of the block means 14). Bearing surfaces are also provided on inner radial surfaces of the central aperture and on the outer radial surfaces of the spigot member which contact one another in use.

In another alternative embodiment (not shown) the block means is formed as a single member provided with a central aperture with a first section and a second section with a greater diameter.

In one other alternative embodiment (not shown) the first and the second portions 2 and 3 are not provided with flanges 5 and 7, and the block member is provided with the same axial cross-section as the first and second portion. Thus the pivot point is provided without any physical barrier as described above being present between the portions 2 and 3.

Thus a rowing oar handle is provided with alleviates the stress placed on a rower's hands in two ways. Firstly the rower's outer hand does not need to perform the feathering motion, and secondly the handle is provided with an axial cross-sectional shape which causes less compression of the flesh of the hands, and therefore fewer injuries.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method of using a rowing oar handle in competitive rowing to feather a blade, the method comprising the steps of:

providing a rowing oar having a blade, shank, and a handle, in which when the handle is orientated for a stroke the handle has an axial cross-sectional shape having a top upper surface, an underside, the handle having a first portion proximal to a user and a second portion distal to the user, the handle having a first hand grip portion and a first flange at a first hand grip inner edge, the first hand grip adapted to be gripped by the user's first hand, the handle having a second hand grip portion adapted to be gripped by the user's second hand, which the first hand grip portion is freely rotatable during rowing in relation to the second hand grip portion such that a point of rotation is located at the first hand grip inner edge, which is also between the regular positions of the user's two hands on the handle, and in which the second hand grip portion is adapted to be non-rotatable in relation to an associated rowing oar blade, such that rotation of the second hand grip portion in use rotates the associated rowing oar blade for a purpose of feathering the blade;

gripping the handle with a hand-grip orientation comprising placing the first hand on a first side of the point of rotation and the second hand on a second side of the point of rotation, and with both hands arranged with a thumb of each hand on an underside of the handle and fingers of each hand over the top upper surface of the handle and wrapped therearound;

pulling repetitive strokes with said hand-grip orientation on the handle with the first portion proximal to the user and the second portion distal to the user, and with both hands arranged with their thumbs on the underside of the handle and their fingers over the top upper surface of the handle and wrapped therearound; and rotating the second hand grip portion of the handle through substantially 90 degrees between each stroke for a purpose of feathering the associated rowing oar blade while not rotating the first hand grip portion.

2. The method of claim 1, in which the handle further comprises an outer end at which the handle terminates, and an inner end in which in use is adjacent an oar body, and in which the first hand grip portion is located outside the second hand grip portion, said method further comprising the steps of:

gripping the handle with the first hand on the first hand grip portion and the second hand on the second hand grip portion, rotating the second hand grip portion of the handle between strokes through substantially 90 degrees using the second hand while not rotating the first hand grip portion with the first hand.

* * * * *